US010578316B2

(12) United States Patent
Jiang et al.

(10) Patent No.: US 10,578,316 B2
(45) Date of Patent: Mar. 3, 2020

(54) RANGE HOOD

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Jiwu Jiang, Foshan (CN); Yali Bai, Foshan (CN); Zhuochun Gu, Foshan (CN); Zulong Song, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 159 days.

(21) Appl. No.: 15/893,318

(22) Filed: Feb. 9, 2018

(65) Prior Publication Data

US 2018/0163975 A1 Jun. 14, 2018

Related U.S. Application Data

(63) Continuation of application No. PCT/CN2016/072147, filed on Jan. 26, 2016.

(30) Foreign Application Priority Data

Sep. 8, 2015 (CN) ..... 2015 1 0567831
Sep. 8, 2015 (CN) ..... 2015 1 0567834
(Continued)

(51) Int. Cl.
*F24C 15/20* (2006.01)

(52) U.S. Cl.
CPC ..... *F24C 15/2042* (2013.01); *F24C 15/2071* (2013.01); *F24C 15/2092* (2013.01); *F24C 15/20* (2013.01)

(58) Field of Classification Search
CPC .. F24C 15/20; F24C 15/2042; F24C 15/2071; F24C 15/2092; F04D 25/16
(Continued)

(56) References Cited

U.S. PATENT DOCUMENTS 3,194,146 A * 7/1965 Jenson ..... F24C 15/2021 126/299 D
4,089,328 A * 5/1978 Bergmark ..... F24C 15/20 126/299 D
(Continued)

FOREIGN PATENT DOCUMENTS

AT 387508 B 2/1989
CA 1045886 A 1/1979
(Continued)

OTHER PUBLICATIONS

Midea, International Search Report and Written Opinion, PCT/CN2016/072147, dated Jun. 15, 2016, 23 pgs.
(Continued)

*Primary Examiner* — Edelmira Bosques
*Assistant Examiner* — Nikhil P Mashruwala
(74) *Attorney, Agent, or Firm* — Morgan, Lewis & Bockius LLP

(57) ABSTRACT

A range hood is provided. The range hood includes a volute casing, a volute casing air inlet and a volute casing exhaust outlet in communication with a hood exhaust outlet are provided in the volute casing. The volute casing includes a fixed housing part and a movable housing part, the movable housing part is movable relative to the fixed housing part; the fixed housing part is fitted with the movable housing part and air is discharged from the volute casing exhaust outlet when the movable housing part is in a closed position; the movable housing part is staggered relative to the fixed housing part to allow the air to be discharged into a room
(Continued)

when the movable housing part is in an open position. When the range hood exhausts air to the room, a flow distance of the air is short, improving operational efficiency.

20 Claims, 9 Drawing Sheets

(30) Foreign Application Priority Data

Sep. 8, 2015 (CN) ..... 2015 1 0567942
Sep. 8, 2015 (CN) ..... 2015 2 0691529 U
Sep. 8, 2015 (CN) ..... 2015 2 0692044 U
Sep. 8, 2015 (CN) ..... 2015 2 0692540 U
Sep. 8, 2015 (CN) ..... 2015 2 0692664 U
Sep. 8, 2015 (CN) ..... 2015 2 0696646 U
Sep. 8, 2015 (CN) ..... 2015 2 0696670 U

(58) Field of Classification Search
USPC ..... 126/299
See application file for complete search history.

(56) References Cited

U.S. PATENT DOCUMENTS 4,418,261 A * 11/1983 Jailor ..... H05B 6/6423 126/21 A
5,042,458 A * 8/1991 Spencer ..... F24C 15/2042 126/21 A
5,107,566 A 4/1992 Schmid
5,738,083 A * 4/1998 Pettinari ..... F24C 15/20 126/299 D
6,073,305 A * 6/2000 Hesskamp ..... A47L 5/14 15/405
6,216,686 B1 * 4/2001 Chiu ..... F24C 15/20 126/299 D
8,074,637 B2 * 12/2011 Yamauchi ..... F24C 15/2021 126/299 D
8,783,245 B2 7/2014 Saraf et al.
9,010,313 B2 * 4/2015 Mikulec ..... F24C 15/2021 126/299 D
9,255,714 B2 * 2/2016 Mikulec ..... F24C 15/2021
10,060,634 B2 * 8/2018 Jiang ..... F04D 29/00
2006/0081367 A1 4/2006 Chiu et al.
2013/0087133 A1 * 4/2013 Davis ..... F24C 15/20 126/299 D
2019/0162421 A1 * 5/2019 Cimino ..... F24C 15/2042

FOREIGN PATENT DOCUMENTS

CN 201476129 U 5/2010
CN 102261690 A 11/2011
CN 104235919 A 12/2014
CN 104501244 A 4/2015
CN 105090121 A 11/2015
CN 105091057 A 11/2015
CN 105091058 A 11/2015
CN 204985080 U 1/2016
CN 204987167 U 1/2016
CN 204987168 U 1/2016
DE 2649154 A1 5/1977
EP 0940632 A1 9/1999
EP 0940633 A2 9/1999
GB 1055720 A 1/1967
GB 2235016 A 2/1991
JP H0628522 U 4/1994

OTHER PUBLICATIONS

Midea Group Co. Ltd./Guangdong Midea Kitchen Appliances Manufacturing Co. Ltd., First Office Action, CN201510567831.1, dated Jan. 4, 2017, 12 pgs.
Midea Group Co. Ltd./Guangdong Midea Kitchen Appliances Manufacturing Co. Ltd., Second Office Action, CN201510567831.1, dated Apr. 21, 2017, 8 pgs.
Midea Group Co. Ltd./Guangdong Midea Kitchen Appliances Manufacturing Co. Ltd., First Office Action, CN201510567834.5, dated Jan. 3, 2017, 24pgs.
Guangdong Midea Kitchen Appliances Manufacturing Co., Ltd. et al., Communication Pursuant to Rules 70(2) and 70a(2), EP16843359.7, Mar. 15, 2019, 11 pgs.

* cited by examiner

RANGE HOOD

PRIORITY CLAIM AND RELATED APPLICATION

This application is a continuation application of PCT/CN2016/072147, entitled "RANGE HOOD" filed on Jan. 26, 2016, which claims priority to (i) Chinese Patent Application No. 201510567834.5, filed with the State Intellectual Property Office of the People's Republic of China on Sep. 8, 2015, (ii) Chinese Patent Application No. 201520692664.9, filed with the State Intellectual Property Office of the People's Republic of China on Sep. 8, 2015, (iii) Chinese Patent Application No. 201510567942.2, filed with the State Intellectual Property Office of the People's Republic of China on Sep. 8, 2015, (iv) Chinese Patent Application No. 201520692540.0, filed with the State Intellectual Property Office of the People's Republic of China on Sep. 8, 2015, (v) Chinese Patent Application No. 201510567831.1, filed with the State Intellectual Property Office of the People's Republic of China on Sep. 8, 2015, (vi) Chinese Patent Application No. 201520691529.2, filed with the State Intellectual Property Office of the People's Republic of China on Sep. 8, 2015, (vii) Chinese Patent Application No. 201520692044.5, filed with the State Intellectual Property Office of the People's Republic of China on Sep. 8, 2015, (viii) Chinese Patent Application No. 201520696646.8, filed with the State Intellectual Property Office of the People's Republic of China on Sep. 8, 2015, and (ix) Chinese Patent Application No. 201520696670.1, filed with the State Intellectual Property Office of the People's Republic of China on Sep. 8, 2015, all of which are incorporated herein by reference in their entirety.

TECHNICAL FIELD

The present disclosure relates to a field of kitchen appliances, more particularly to a range hood.

BACKGROUND

Although a range hood can achieve a function of discharging air into a room and discharging the air outside the room, the internal circulation air passage is too long when the air is discharged into the room, which causes a relatively large loss of air quantity and air pressure. While the range hood with double fans has a relatively large left-and-right size and a relatively high cost; since a switching plate is opened or closed towards an external direction of a volute casing spiral, the air pressure in a volute casing air passage will jack up a movable housing part, and in particular when the air pressure is large at a high speed level, a connection gap jacked up will generate an air flow whistle with high frequency, which results in poor sound quality.

SUMMARY

The present disclosure seeks to solve at least one of the problems existing in the related art to at least some extent. To this end, the present disclosure proposes a range hood with a relatively short air flow distance when the air is discharged into a room.

The range hood according to the present disclosure includes: a hood housing provided with a hood circulating air outlet and a hood exhaust outlet; a volute casing, having at least a portion disposed in the hood housing, defining a volute casing air passage therein, provided with a volute casing air inlet and a volute casing exhaust outlet that is in communication with the hood exhaust outlet, and including a fixed housing part and a movable housing part, and the movable housing part being movable between a closed position and an open position relative to the fixed housing part. When the movable housing part is in the closed position, the fixed housing part is fitted with the movable housing part and air in the volute casing air passage is configured to be discharged from the volute casing exhaust outlet; when the movable housing part is in the open position, the movable housing part is staggered relative to the fixed housing part to define a volute casing circulating air outlet in communication with the hood circulating air outlet and between the movable housing part and the fixed housing part, so as to allow the air in the volute casing air passage to be discharged into a room through the volute casing circulating air outlet and the hood circulating air outlet sequentially.

In the range hood according to the present disclosure, the volute casing is configured as the fixed housing part and the movable housing part, and the movable housing part is movable relative to the fixed housing part so as to move between the open position and the closed position, such that the range hood can have a function of discharging the air into the room and discharging the air outside the room. Since the air in the volute casing air passage can flow to the hood circulating air outlet directly through the volute casing circulating air outlet when the air is discharged into the room, the flow distance of the air can be effectively shortened when the range hood discharges the air into the room, the loss of air quantity and air pressure can be reduced to some extent, and exhaust efficiency from the range hood into the room can be improved.

Additionally, the range hood according to the present disclosure may further have the following technical features.

In some examples of the present disclosure, the fixed housing part includes a baseplate part, the volute casing air inlet being provided in the baseplate part; a fixed side wall part fixedly disposed to the baseplate part and surrounding the volute casing air inlet, in which a position of the movable housing part relative to the fixed side wall part is adjustable to define the volute casing circulating air outlet between the movable housing part and the fixed side wall part when the movable housing part is in the open position.

In some examples of the present disclosure, the movable housing part is in smooth connection with the fixed side wall part in an extending direction of the volute casing air passage when the movable housing part is in the closed position.

In some examples of the present disclosure, a molded line of the movable housing part is on the same spiral as a molded line of the fixed side wall part when the movable housing part is in the closed position.

In some examples of the present disclosure, the fixed side wall part includes a first fixed side wall part and a second fixed side wall part spaced apart from each other; the movable housing part is disposed between the first fixed side wall part and the second fixed side wall part; and two ends of the movable housing part are in butt joint with the first fixed side wall part and the second fixed side wall part respectively when the movable housing part is in the closed position so that the first fixed side wall part, the movable housing part and the second fixed side wall part are continuous in an extending direction of the volute casing air passage.

In some examples of the present disclosure, the volute casing exhaust outlet is defined between a free end of the first fixed side wall part and a free end of the second fixed side wall part.

In some examples of the present disclosure, the movable housing part is pivotal about a pivoting shaft relative to the fixed side wall part.

In some examples of the present disclosure, the pivoting shaft is disposed to the second fixed side wall part, a pivoting end of the movable housing part is connected to the pivoting shaft while the other end of the movable housing part abuts a fitting end of the first fixed side wall part, and the fitting end of the first fixed side wall part is an end opposite to the free end of the first fixed side wall part.

In some examples of the present disclosure, the first fixed side wall part is an arc-shaped wall and an opening of the first fixed side wall faces the second fixed side wall part, and the second fixed side wall part is formed as a substantially flat-plate structure.

In some examples of the present disclosure, two fixed side wall parts are provided and symmetrically arranged on the baseplate part, openings of the first fixed side wall parts of the two fixed side wall parts face each other, and the two fixed side wall parts share the same second fixed side wall part.

In some examples of the present disclosure, the volute casing circulating air outlet is located in front of the second fixed side wall part, the volute casing exhaust outlet is located behind the second fixed side wall part, and the volute casing air inlets are located at left and right sides of the second fixed side wall part respectively.

In some examples of the present disclosure, the range hood further includes a fan wheel assembly, in which the fan wheel assembly is at least partially disposed in the volute casing air passage and includes a fan wheel and a drive motor, and a minimum distance L between the movable housing part and the fan wheel satisfies a relation: $5\ mm \leq L \leq 30\ mm$.

In some examples of the present disclosure, the L further satisfies a relation: $L=10\ mm$.

In some examples of the present disclosure, the movable housing part is rotatable relative to the fixed housing part via a pivoting shaft, a pivoting end of the movable housing part is connected to the pivoting shaft while the other end of the movable housing part is a free end, and a distance between the free end of the movable housing part and the fan wheel is the minimal.

In some examples of the present disclosure, the range hood further includes a fan wheel assembly and a first limiting device, in which the fan wheel assembly is at least partially disposed in the volute casing air passage and includes a fan wheel and a drive motor, and the first limiting device is disposed to the fixed housing part and located between the fan wheel and the movable housing part.

In some examples of the present disclosure, the range hood further includes a second limiting device, in which the second limiting device is disposed to the fixed housing part and located outside the movable housing part.

In some examples of the present disclosure, the range hood further includes a holding device, in which the holding device is configured to hold the movable housing part in the open position.

In some examples of the present disclosure, the range hood further includes a switching drive device, in which the switching drive device is configured to drive the movable housing part to move towards the open position.

In some examples of the present disclosure, the range hood further includes a switching push plate configured to drive the movable housing part to move towards the open position.

In some examples of the present disclosure, the switching drive device further includes a switching push handle, in which at least a part of the switching push handle is exposed outside the volute casing and is connected to the switching push plate.

In some examples of the present disclosure, the switching push handle includes a connecting rod part and a handle part, the handle part is exposed outside the volute casing, and the connecting rod part is fixed to the handle part and connected to the switching push plate.

In some examples of the present disclosure, the switching push plate is provided with an air guiding surface configured to guide circulating air discharged from the volute casing circulating exhaust outlet.

In some examples of the present disclosure, the movable housing part is reset from the open position to the closed position under the action of air pressure in the volute casing air passage.

In some examples of the present disclosure, the volute casing includes: the fixed housing part including a baseplate part and a plurality of fixed side wall parts, the volute casing air inlet being provided in the baseplate part, and each fixed side wall part being fixedly disposed to the baseplate part and surrounding the respective volute casing air inlet; a plurality of the movable housing parts corresponding to the plurality of fixed side wall parts, and each movable housing part being movable between the closed position and the open position relative to the respective fixed side wall part, in which the movable housing part is staggered relative to the fixed side wall part to define the volute casing circulating air outlet between the movable housing part and the fixed side wall part when the movable housing part is in the open position, and the volute casing circulating air outlet is configured to allow the air in the volute casing air passage to be discharged into the room through the volute casing circulating air outlet. Additionally, the range hood further includes a switching drive device configured to drive the plurality of movable housing parts to interact synchronously so that the plurality of movable housing part can be moved synchronously to the open position.

In some examples of the present disclosure, the switching drive device includes: a switching push plate configured to drive two movable housing parts to move synchronously towards the open position; a switching push handle, at least a part of the switching push handle being exposed outside the volute casing and connected to the switching push plate, the switching push handle including a connecting rod part and a handle part, the handle part being exposed outside the volute casing, and the connecting rod part being fixed to the handle part and connected to the switching push plate.

In some examples of the present disclosure, the hood circulating air outlet is provided in the hood housing located above a front of the volute casing circulating air outlet.

In some examples of the present disclosure, the hood housing includes a flat top wall part and an inclined top wall part, the inclined top wall part is disposed to a front side of the flat top wall part, the flat top wall part extends downwardly from rear to front, and the hood circulating air outlet is provided in the inclined top wall part and located at a junction of the inclined top wall part and the flat top wall part.

In some examples of the present disclosure, the hood circulating air outlet is arranged adjacent to the volute casing circulating air outlet.

In some examples of the present disclosure, the range hood further includes a head structure configured to open or close the hood exhaust outlet.

In some examples of the present disclosure, the range hood further includes an air inlet filter mesh screen disposed at the volute casing air inlet.

Figure 1:
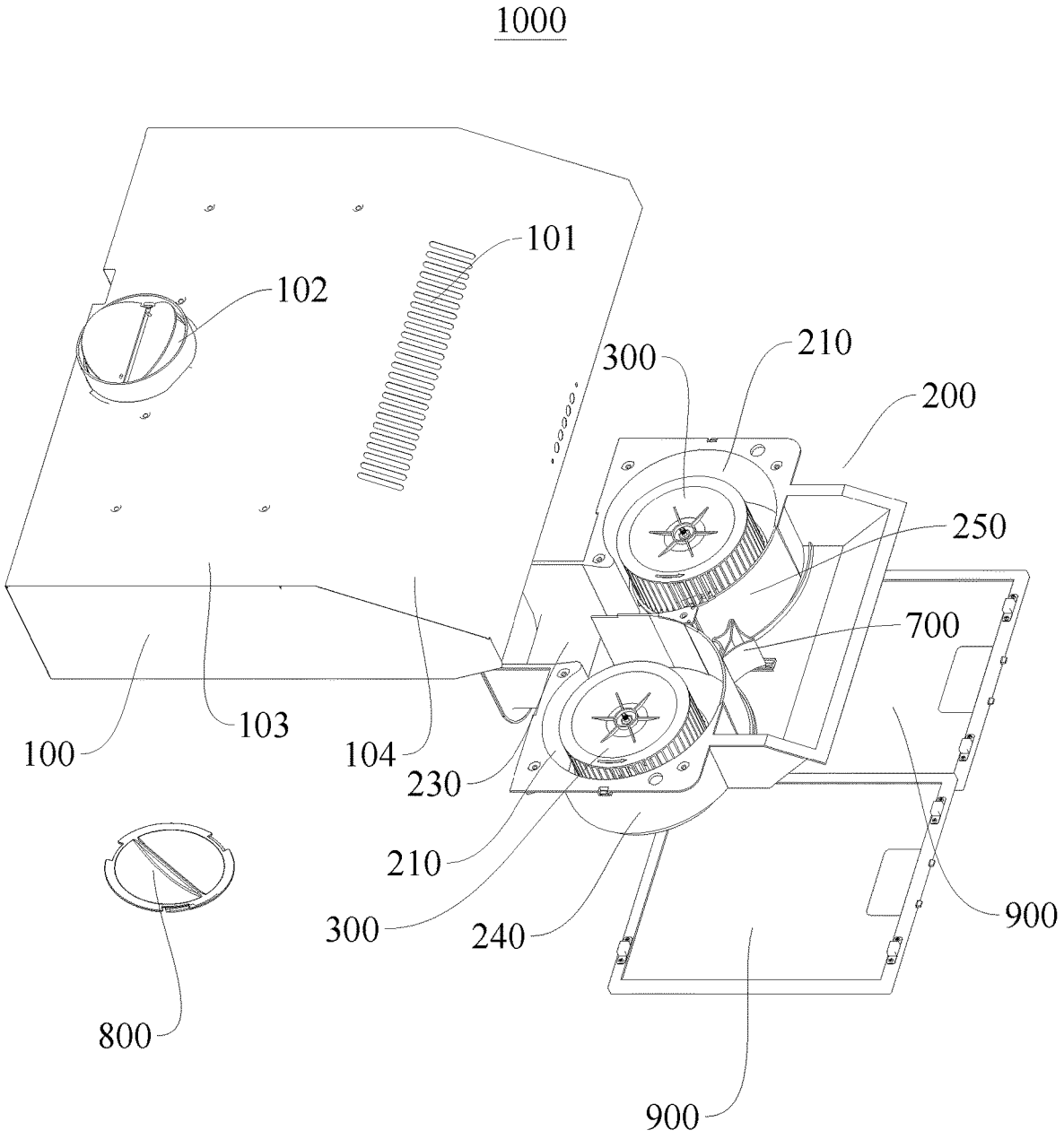
FIG. 1 is an exploded view of a range hood according to an embodiment of the present disclosure.

REFERENCE NUMERALS range hood 1000;

hood housing 100; hood circulating air outlet 101; hood exhaust outlet 102; flat top wall part 103; inclined top wall part 104;

volute casing 200; volute casing air passage 210; volute casing air inlet 220; volute casing exhaust outlet 230; fixed housing part 240; baseplate part 241; fixed side wall part 242; first fixed side wall part 243; second fixed side wall part 244; fitting end 245 for first fixed side wall part;

movable housing part 250; pivoting shaft 251; pivoting end 252; pressing plate 253; volute casing circulating air outlet 260;

fan wheel assembly 300; fan wheel 301; drive motor 302;

first limiting device 400; second limiting device 500;

switching drive device 700; switching push plate 710; air guiding surface 711; switching push handle 720; connecting rod part 721; handle part 722; sliding groove 730;

head structure 800; air inlet filter mesh screen 900;

closed position A1; open position A2.

DETAILED DESCRIPTION

Embodiments of the present disclosure will be described in detail below, and examples of the embodiments are shown in accompanying drawings. The embodiments described herein with reference to drawings are explanatory, illustrative, and used to generally understand the present disclosure. The embodiments shall not be construed to limit the present disclosure.

A range hood 1000 according to an embodiment of the present disclosure will be described below with reference to the drawings.

The range hood 1000 according to embodiments of the present disclosure may include a hood housing 100 and a volute casing 200. As illustrated in FIG. 1, a hood circulating air outlet 101 and a hood exhaust outlet 102 is provided in the hood housing 100. In some embodiments, as illustrated in FIGS. 8 and 9, the hood circulating air outlet 101 is located in front of the hood exhaust outlet 102.

Figure 2:
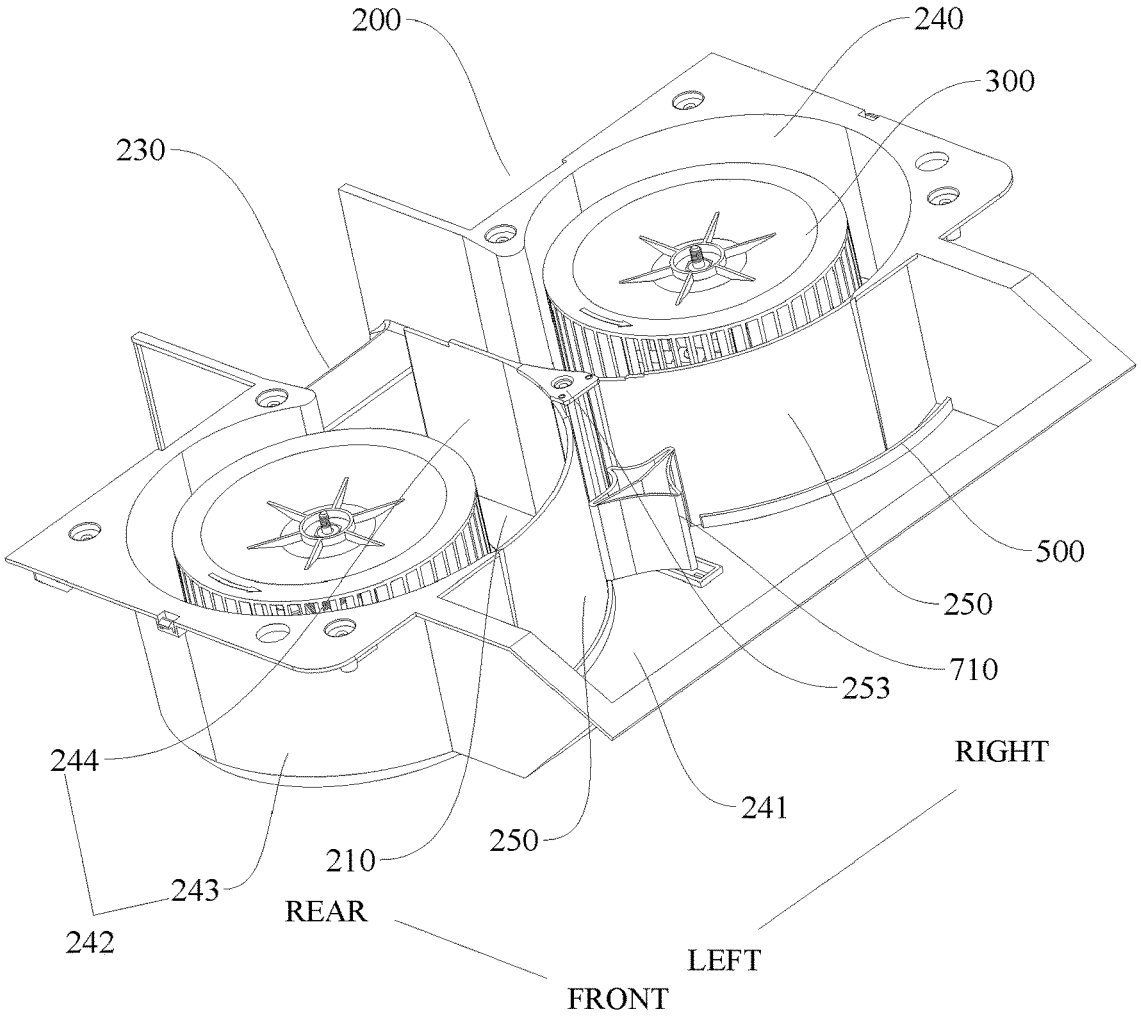
FIG. 2 is a schematic view of a volute casing of a range hood according to an embodiment of the present disclosure, in which the volute casing is assembled with a fan wheel assembly.
Figure 8:
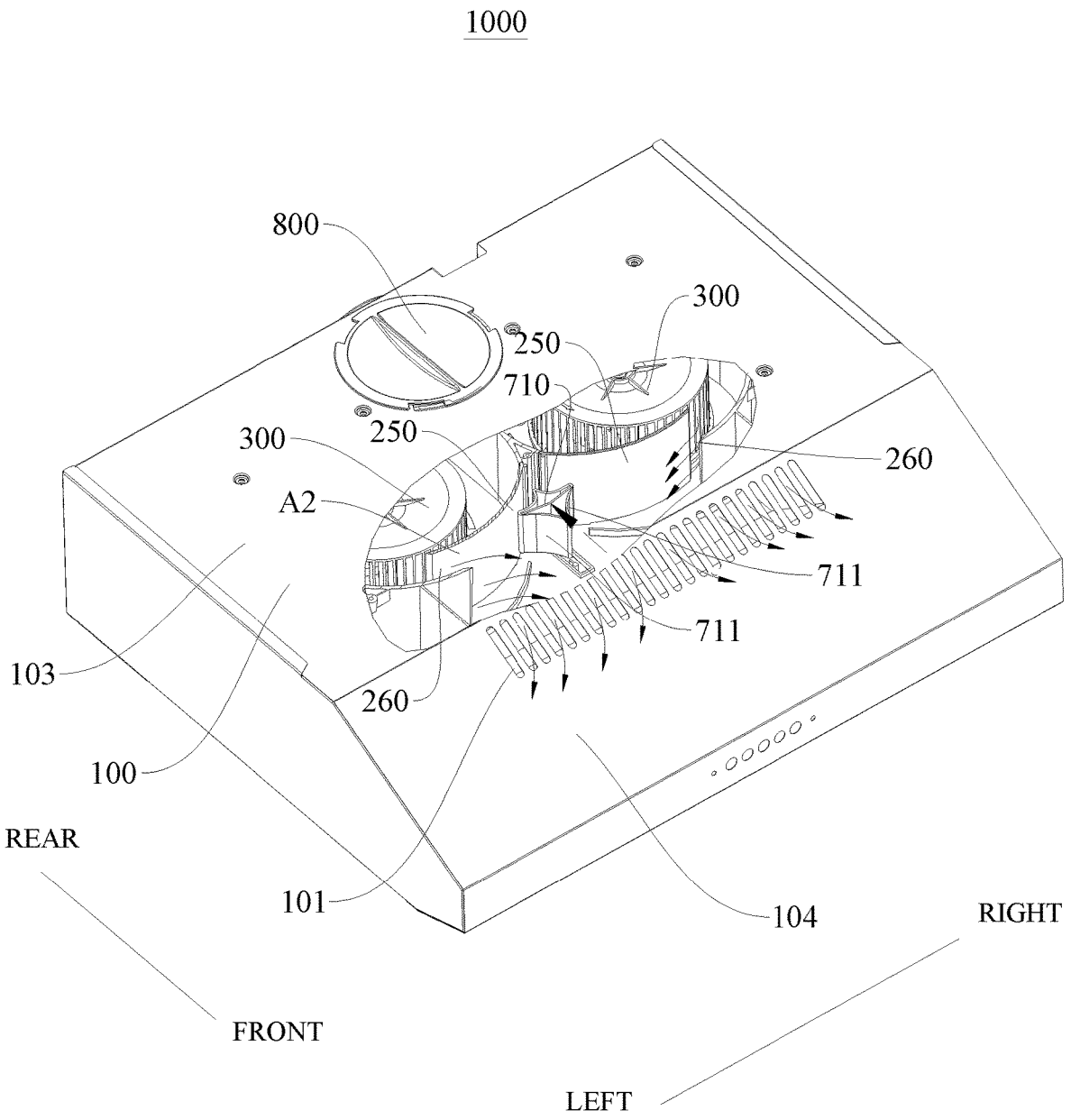
FIG. 8 is a partial sectional view of a range hood according to an embodiment of the present disclosure, in which a movable housing part is in an open position.
Figure 9:
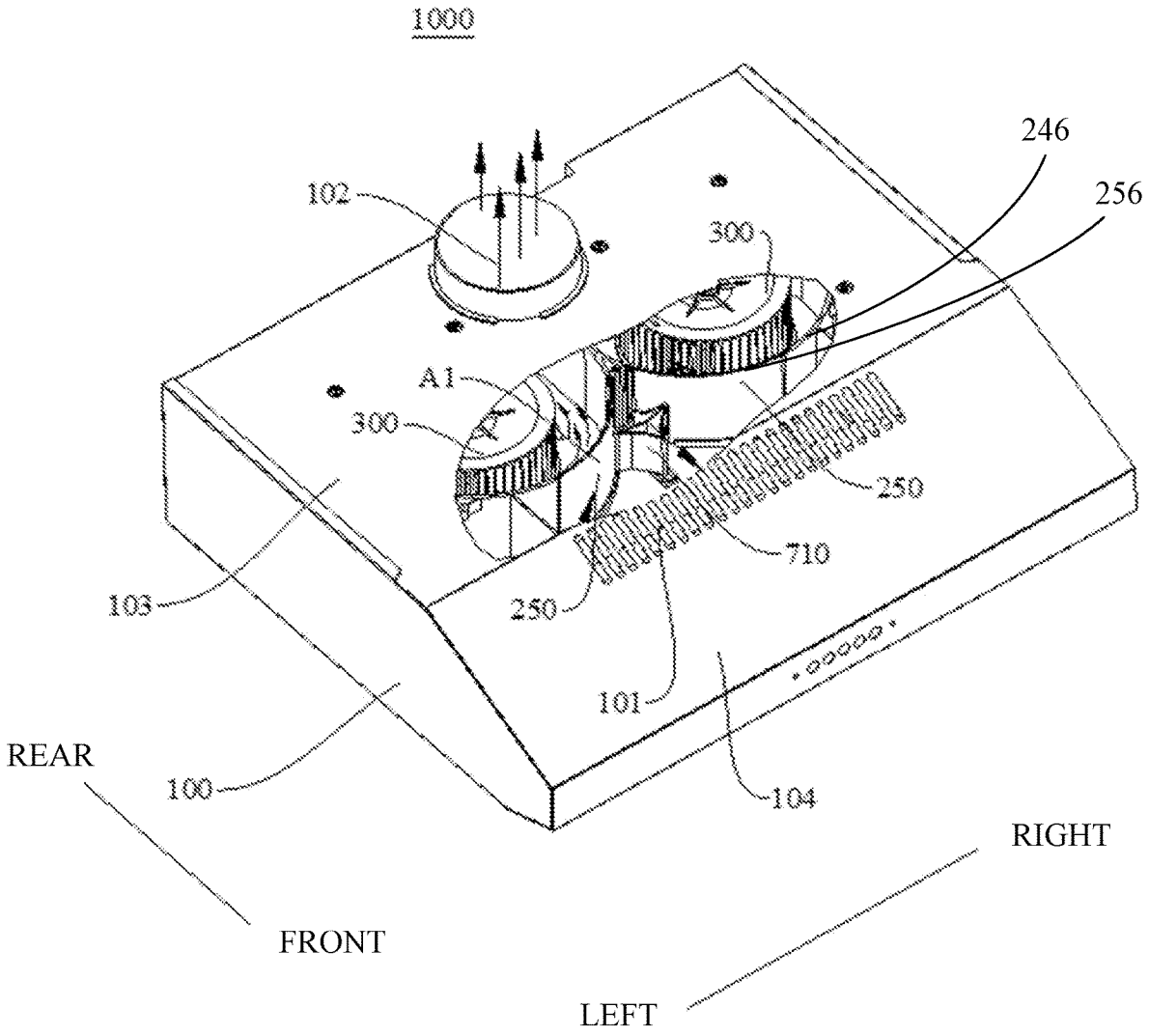
FIG. 9 is a partial sectional view of a range hood according to an embodiment of the present disclosure, in which a movable housing part is in a closed position.

As illustrated in FIGS. 8 and 9, the volute casing 200 is at least partially disposed in the hood housing 100. In some embodiments, the volute casing 200 may be integrally disposed in the hood housing 100, such that the hood housing 100 can protect the volute casing 200 better. As illustrated in FIGS. 1 and 2, the volute casing 200 defines a volute casing air passage 210 therein; a volute casing air inlet 220 and a volute casing exhaust outlet 230 which is in communication with a hood exhaust outlet 102 are provided in the volute casing 200; the volute casing 200 includes a fixed housing part 240 and a movable housing part 250, and the movable housing part 250 is movable relative to the fixed housing part 240 between a closed position A1 and an open position A2. When the movable housing part 250 is in the closed position A1, the fixed housing part 240 is fitted with the movable housing part 250 and allows air in the volute casing air passage 210 to be discharged from the volute casing exhaust outlet 230. When the movable housing part 250 is in the open position A2, the movable housing part 250 is staggered relative to the fixed housing part 240 to define a volute casing circulating air outlet 260 in communication with the hood circulating air outlet 101 and between the movable housing part 250 and the fixed housing part 240, such that the air in the volute casing air passage 210 can be discharged into a room through the volute casing circulating air outlet 260 and the hood circulating air outlet 101 sequentially.

It should be noted that the hood exhaust outlet 102 is in an open state when the movable housing part 250 is in the closed position A1, such that the air in the volute casing air passage 210 can be discharged outside the room through the volute casing exhaust outlet 230 and the hood exhaust outlet 102 sequentially. The hood exhaust outlet 102 is in a closed state when the movable housing part 250 is in the open position A2. In some embodiments, as illustrated in FIGS. 1 and 8, the range hood 1000 may further include a head structure 800 configured to open or close the hood exhaust outlet 102. It should be understood that the head structure 800 closes the hood exhaust outlet 102 when the hood exhaust outlet 102 needs to be closed. In some embodiments, the hood exhaust outlet 102 may be an end cap structure. The end cap structure is provided with a screw thread, and a side wall of the hood exhaust outlet 102 is provided with a screw thread corresponding to the screw thread of the end cap structure, such that the end cap structure can be screwed into the hood exhaust outlet 102 tightly. As illustrated in FIGS. 1, 8 and 9, the hood circulating air outlet 101 may be distributed in a length direction of the hood housing 100 (i.e. a left-and-right direction illustrated in FIG. 8). The hood circulating air outlet 101 is normally in the open state, and the air in the volute casing air passage 210 cannot flow to the hood circulating air outlet 101 through the volute casing circulating air outlet 260 when the movable housing part 250 is in the closed position A1. Additionally, an upper end cap of a fan wheel assembly 300 may abut against an inner surface of the hood housing 100, such that the annular volute casing air passage 210 can be defined among the volute casing 200, the fan wheel assembly 300 and the hood housing 100.

The air in the volute casing air passage 210 can be directly discharged from the volute casing air passage 210 through the volute casing circulating air outlet 260 when the movable housing part 250 is in the open position A2, and the air discharged from the volute casing air passage 210 can be discharged into the room directly through the hood circulating air outlet 101. Thus, the air has a relatively short flow distance in the volute casing 200 when the range hood 1000 discharges the air into the room, such that a loss of air quantity and air pressure can be reduced to some extent, and exhaust efficiency of the range hood 1000 into the room can be improved.

According to one embodiment of the present disclosure, as illustrated in FIGS. 8 and 9, the hood circulating air outlet 101 may be provided in the hood housing 100 located above a front of the volute casing circulating air outlet 260. As illustrated in FIG. 8, an arrow indicates a flow direction of the air in the range hood 1000, it can be seen that the air flowing out of the volute casing circulating air outlet 260 is discharged forwardly, and since the hood circulating air outlet 101 is located above the front of the volute casing circulating air outlet 260, the air can directly flow forwardly and upwardly, such that a flow velocity of the air can be maintained, and the exhaust efficiency of the range hood 1000 can be further improved. In some embodiments, as illustrated in FIG. 8, the hood circulating air outlet 101 can be located adjacent to the hood exhaust outlet 260. Thus, the flow distance of the air from the volute casing circulating air outlet 260 to the hood circulating air outlet 101 can be further shortened, and the air exhaust efficiency of the range hood 1000 into the room can be improved.

In some embodiments, as illustrated in FIGS. 1, 8 and 9, the hood housing 100 may include a flat top wall part 103 and an inclined top wall part 104, the inclined top wall part 104 is disposed to a front side of the flat top wall part 103, the flat top wall part 103 extends downwardly from rear to front, and the hood circulating air outlet 101 can be provided in the inclined top wall part 104 and located at a junction of the inclined top wall part 104 and the flat top wall part 103. Thus, the air discharged through the hood circulating air outlet 101 may flow upwardly and forwardly, such that the air can be prevented form flowing upwardly directly, a diffusion velocity of the air in the room can be further accelerated, a temperature rise of the room can be accelerated, and user experience can be improved.

In some embodiments, as illustrated in FIG. 1, the range hood 1000 may further include an air inlet filter mesh screen 900 disposed at the volute casing air inlet 220.

Figure 4:
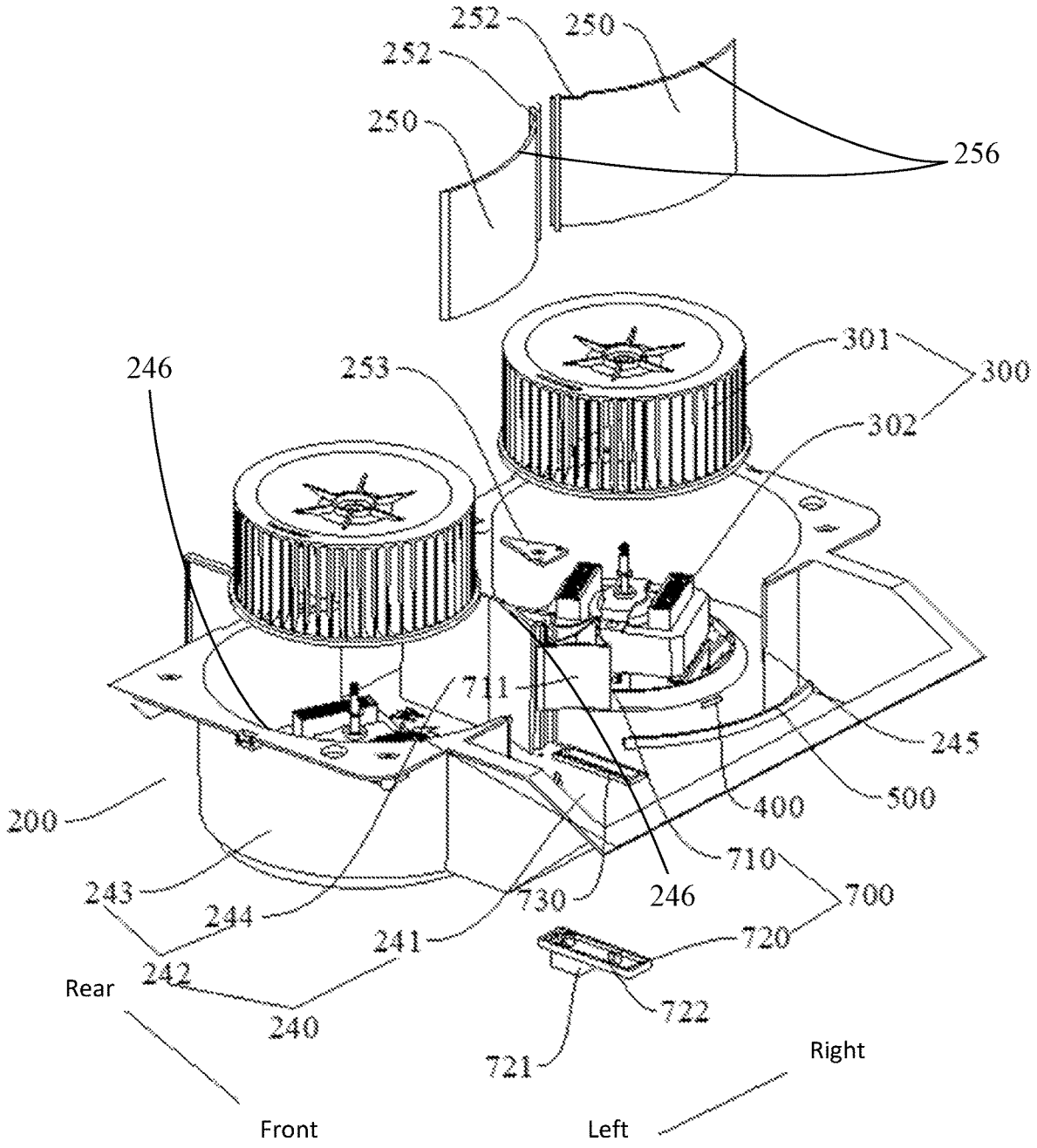
FIG. 4 is an exploded view of a volute casing and a fan wheel assembly according to an embodiment of the present disclosure.

The fan wheel assembly 300 is at least partially disposed in the volute casing air passage 210 and the fan wheel assembly 300 includes a fan wheel 301 and a drive motor 302. As illustrated in FIG. 4, the drive motor 302 may be disposed in the volute casing 200, the fan wheel 301 covers an outer side of the drive motor 302, and the fan wheel 301 is connected to the drive motor 302. Under the drive of the drive motor 302, the fan wheel 301 can draw the air from the volute casing air inlet 220 such that the air can enter the volute casing air passage 210 and can flow in the volute casing air passage 210.

In the range hood 1000 according to the present disclosure, the volute casing is configured as the fixed housing part 240 and the movable housing part 250, and the movable housing part 240 is movable relative to the fixed housing part 240 so as to move between the open position A2 and the closed position A1, such that the range hood 1000 can have a function of discharging the air into the room and discharging the air outside the room. Since the air in the volute casing air passage 210 can flow to the hood circulating air outlet 101 directly through the volute casing circulating air outlet 260 when the air is discharged into the room, the flow distance of the air can be effectively shortened when the range hood 1000 discharges the air into the room, the loss of the air quantity and the air pressure can be reduced to some extent, and the exhaust efficiency from the range hood 1000 into the room can be improved.

The volute casing 200 of the range hood 1000 according to embodiments of the present disclosure will be described below with reference to the drawings.

Figure 3:
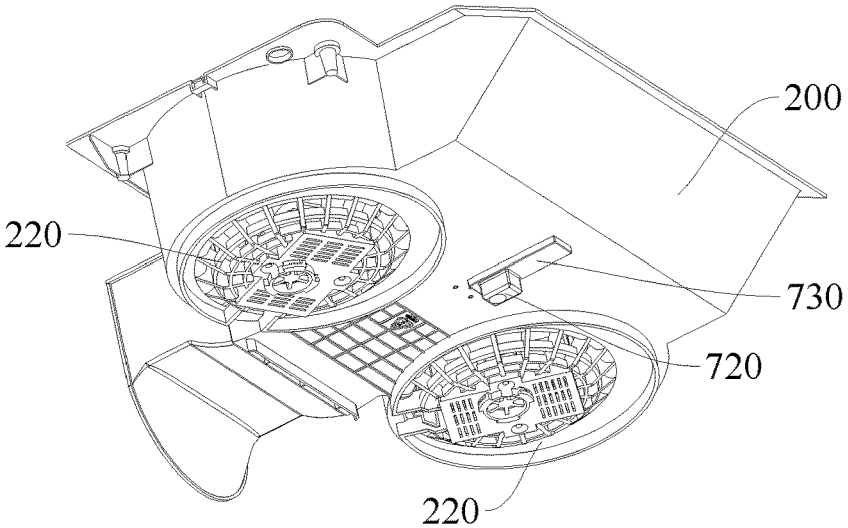
FIG. 3 is a perspective view of a volute casing of a range hood according to an embodiment of the present disclosure.
Figure 5:
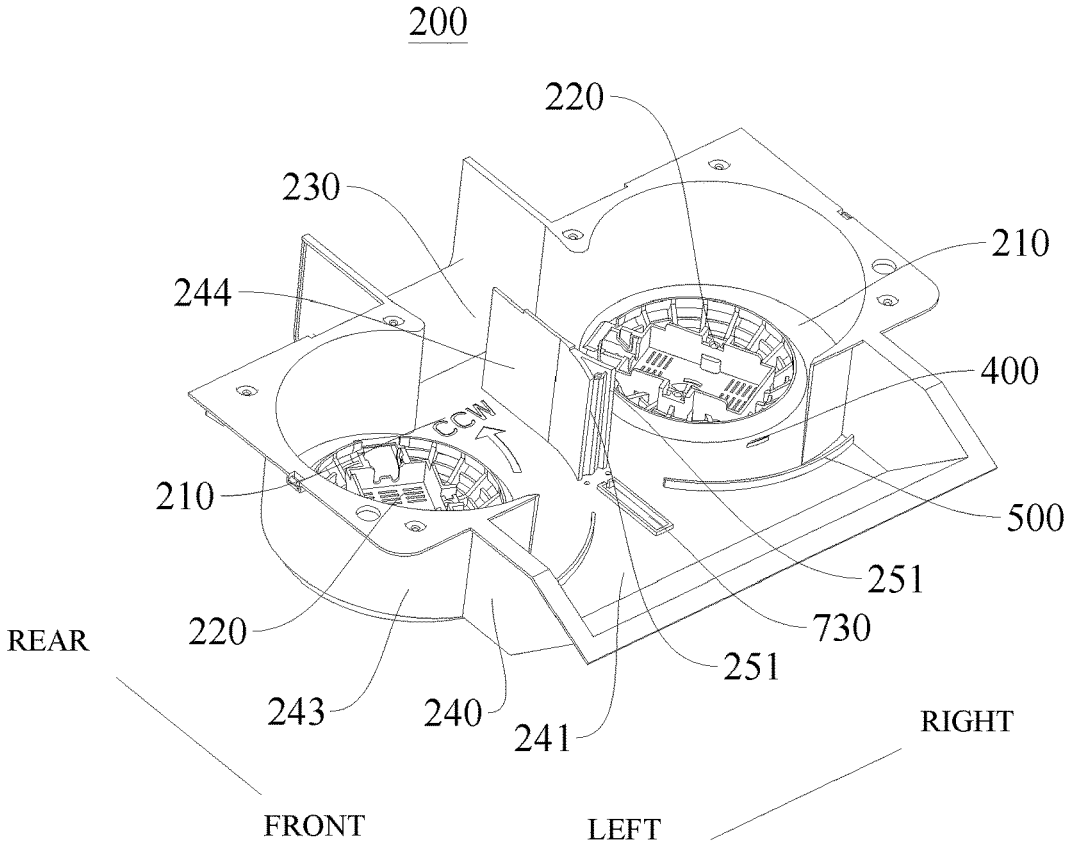
FIG. 5 is a schematic view of a volute casing of a range hood according to an embodiment of the present disclosure.

Referring to FIGS. 2, 4 and 5, the fixed housing part 240 may include a baseplate part 241 and a fixed side wall part 242. As illustrated in FIG. 3, the volute casing air inlet 220 is defined in the baseplate part 241, the fixed side wall part 242 may be fixedly disposed on the baseplate part 241, and the fixed side wall part 242 surrounds the volute casing air inlet 220. In some embodiments, the fixed side wall part 242 may be integrally molded with the baseplate part 241, the integrally molded fixed housing part 240 has a simple structure and high strength, and an assembling process of the fixed side wall part 242 and the baseplate part 241 can also be omitted. A position of the movable housing part 250 is adjustable relative to the fixed side wall part 242 to define the volute casing circulating air outlet 260 between the movable housing part 250 and the fixed side wall part 242 when the movable housing part 250 is in the open position A2.

Figure 10:
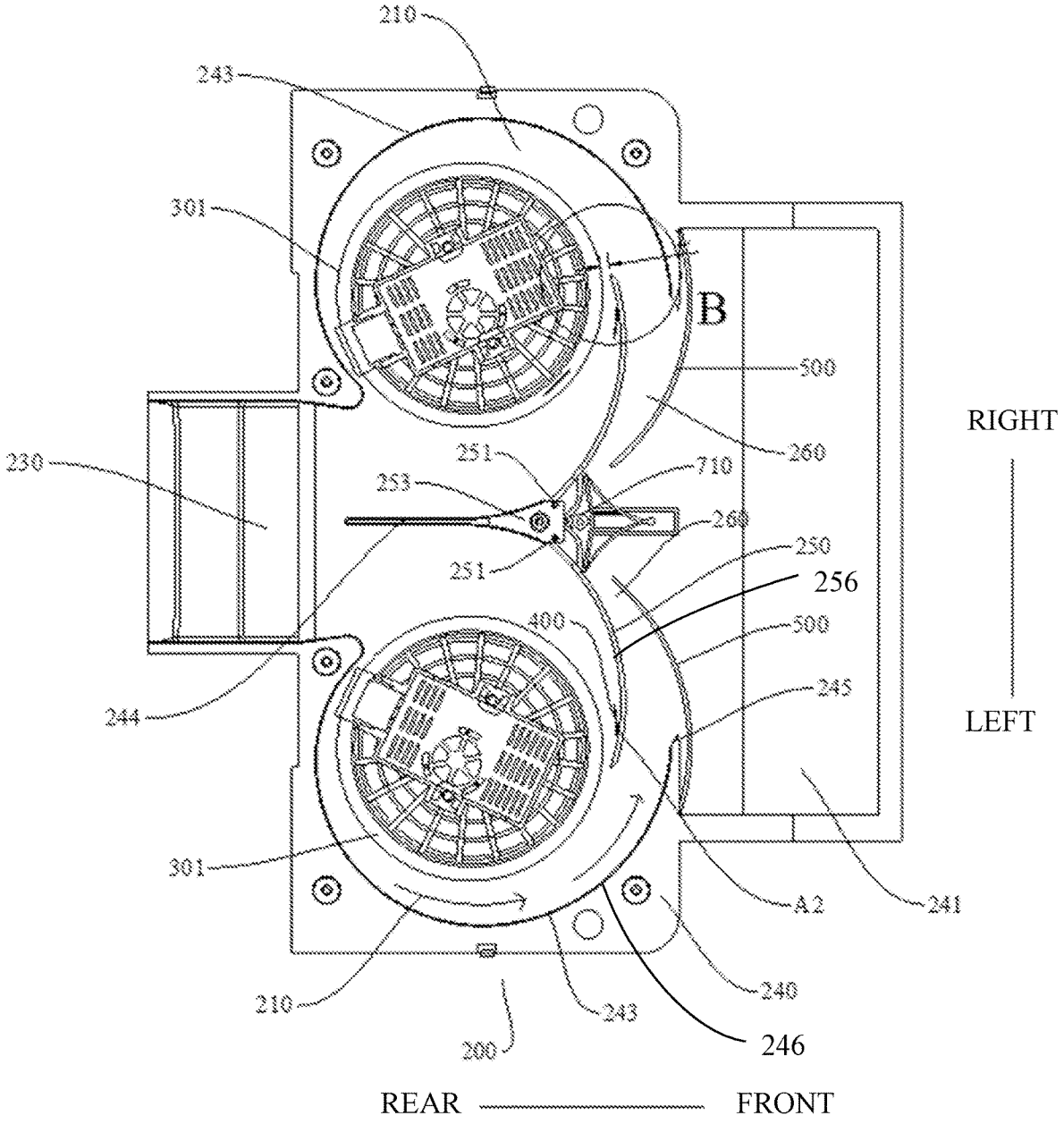
FIG. 10 is a top view of a fan wheel assembly and a volute casing of a range hood according to an embodiment of the present disclosure.

In some embodiments, as illustrated in FIGS. 2, 9 and 10, the movable housing part 250 is in smooth connection with the fixed side wall part 242 in an extending direction of the volute casing air passage 210 when the movable housing part 250 is in the closed position A1. The extending direction of the volute casing air passage 210 is the arrow direction in the volute casing air passage 210 illustrated in FIG. 10, and the extending direction of the volute casing air passage 210 mentioned hereinafter is based on this unless particularly indicated. It should be understood that, the smooth connection between the movable housing part 250 and the fixed side wall part 242 can reduce resistance of the volute casing 200 against the air in the volute casing air passage 210, further reduce a noise produced between the air and the volute casing 200, and also prevent the air from being discharged through the volute casing circulating air outlet 260 to some extent when the movable housing part 250 is in the closed position A1.

In some embodiments, a molded line 256 of the movable housing part 250 is on the same spiral as a molded line 246 of the fixed side wall part 242 when the movable housing part 250 is in the closed position A1. Thus, a better diffusion effect can be ensured when the range hood 1000 discharges the air outside the room, and the range hood 1000 can have the high exhaust efficiency. The molded line 256 of the movable housing part 250 may be formed on an inner surface of the movable housing part 250 facing the fan wheel assembly 300, and the molded line 246 of the fixed side wall part 242 may be formed on an inner surface of the fixed side wall part 242 facing the fan wheel assembly 300.

Further, As illustrated in FIGS. 2, 4 and 5, the fixed side wall part 242 may include a first fixed side wall part 243 and a second fixed side wall part 244, the first fixed side wall part 243 is spaced apart from the second fixed side wall part 244, and the movable housing part 250 is disposed between the first fixed side wall part 243 and the second fixed side wall part 244. Two ends of the movable housing part 250 are connected to the first fixed side wall part 243 and the second fixed side wall part 244 respectively when the movable housing part 250 is in the closed position A1 so as to make the first fixed side wall part 243, the movable housing part 250 and the second fixed side wall part 244 continuous in the extending direction of the volute casing air passage 210.

In some embodiments, a fitting end 245 of the first fixed side wall part 243 may be provided with an inclined guiding edge configured to butt a free end of the movable housing part 250, and the free end of the movable housing part 250 may be provided with an inclined edge fitted with the inclined guiding edge, such that the first fixed side wall part 243 can be in smooth connection with the movable housing part 250 when the movable housing part 250 is in the closed position A1 and a connection relation therebetween can be stable.

Specifically, as illustrated in FIG. 5, the volute casing exhaust outlet 230 is defined between a free end of the first fixed side wall part 243 and a free end of the second fixed side wall part 244. The free end of the first fixed side wall part 243 is a rear end of the first fixed side wall part 243 illustrated in FIG. 5, and the free end of the second fixed side wall part 244 is a rear end of the second fixed side wall part 244 illustrated in FIG. 5. It should be understood that, the volute casing exhaust outlet 230 faces rearward, the hood exhaust outlet 102 may be provided above the volute casing exhaust outlet 230, the range hood 1000 is mounted on a wall in the room, and when the air in the volute casing air passage 210 flows rearward from the volute casing exhaust outlet 230, the air flows upwardly until the air is discharged outside the room through the hood exhaust outlet 102 under the limits of the wall and the volute casing 200.

In some embodiments, the movable housing part 250 may be pivotable about a pivoting shaft 251 relative to the fixed side wall part 242. Specifically, the pivoting shaft 251 is disposed to the second fixed side wall part 244, a pivoting end 252 of the movable housing part 250 is connected to the pivoting shaft 251, and the other end of the movable housing part 250 abuts the fitting end 245 of the first fixed side wall part 243, the fitting end 245 of the first fixed side wall part 243 being an end of the first fixed side wall part 243 opposite to the free end of the first fixed side wall part 243. As illustrated in FIG. 10, the range hood 1000 may further include a pressing plate 253, the pressing plate 253 can mount the pivoting end 252 of the movable housing part 250 to a position of the pivoting shaft 251 of the second fixed side wall part 244, such that the movable housing part 250 is pivotable about the pivoting shaft 251 between the open position A2 and the closed position A1.

In some specific examples of the present disclosure, the first fixed side wall part 243 may be an arc-shaped wall and an opening of the first fixed side wall 243 faces the second fixed side wall part 244, and the second fixed side wall part 244 may be formed as a substantially flat-plate structure.

In some embodiments, as illustrated in FIG. 10, two fixed side wall parts 242 are provided and symmetrically arranged on the baseplate part 241, openings of the first fixed side wall parts 243 of the two fixed side wall parts 242 face each other, and the two fixed side wall parts 242 share the same second fixed side wall part 244. Thus, the material used for the volute casing 200 can be reduced, a weight of the volute casing 200 can be reduced, and a volume and a cost of the volute casing 200 can be reduced. Correspondingly, the volute casing 200 can be provided with two movable housing parts 250, and each movable housing part 250 is disposed between the respective first fixed side wall part 243 and the second fixed side wall part 244.

In one specific embodiment of the present disclosure, the volute casing circulating air outlet 260 may be located in front of the second fixed side wall part 244, the volute casing exhaust outlet 230 may be located behind the second fixed side wall part 244, and the volute casing air inlets 220 are located at left and right sides of the second fixed side wall part 244 respectively. As illustrated in FIG. 10, the volute casing 200 can define two volute casing air passages 210 by the two fixed side wall parts 242 and the two movable housing parts 250, and the two volute casing air passages 210 are located at the left and right sides of the second fixed side wall part 244 respectively. Thus, the two volute casing air passages 210 do not interfere with each other, the air can be introduced into each volute casing air passage 210 independently through the corresponding volute casing air inlet 220, the air can be discharged outside the room through the corresponding volute casing exhaust outlet 230 and the hood exhaust outlet 102, and the air can be discharged into the room through the corresponding volute casing circulating air outlet 260 and the hood circulating air outlet 101.

A definite relation between the movable housing part 250 and the fan wheel 301 of the range hood 1000 according to embodiments of the present disclosure will be described below with reference to the drawings.

Figure 11:
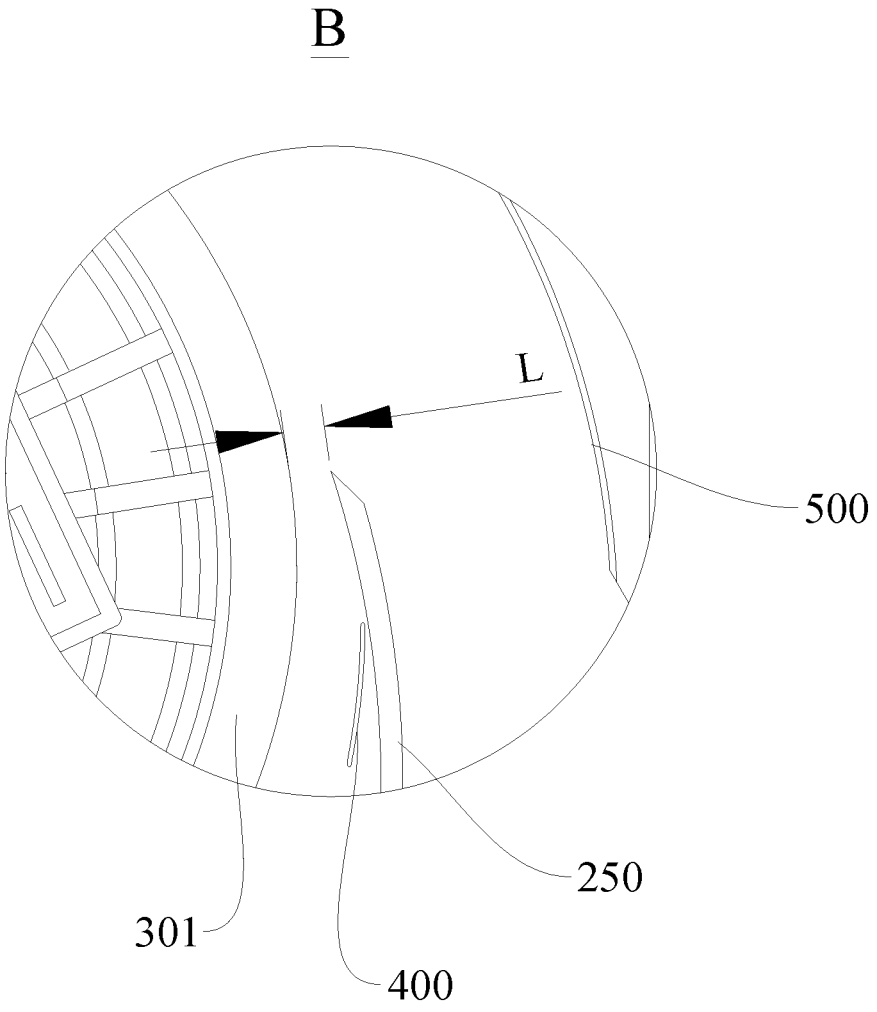
FIG. 11 is an enlarged view of part B in FIG. 10.

In some examples of the present disclosure, as illustrated in FIG. 11, a minimum distance L between the movable housing part 250 and the fan wheel 301 satisfies a relation: 5 mm≤L≤30 mm. The minimum distance between the movable housing part 250 and the fan wheel 301 indicates that the movable housing part 250 is staggered with the first fixed side wall part 243 and at a maximum staggered distance when the movable housing part 250 is in the open position A2. It should be understood that, when the range hood 1000 is in operation, if a distance between the movable housing part 250 and the fan wheel 301 is too close, air pressure in the volute casing air passage 210 cannot press the movable housing part 250 back to the closed position A1; if the distance between the movable housing part 250 and the fan wheel 301 is too far, the air quantity flowing out of the volute casing circulating air outlet 260 is relatively small, which is not conducive to improving the exhaust efficiency of the range hood 1000. Thus, when L is between 5 mm≤L≤30 mm, the output air quantity of the volute casing circulating air outlet 260 is suitable, and the air pressure in the volute casing air passage 210 can press the movable housing part 250 back to the closed position A1 under a suitable condition. In some embodiments, L may further satisfy a relation: 5 mm≤L≤15 mm. In some embodiments, L may further satisfy a relation: L=10 mm.

In some embodiments, the movable housing part 250 may be rotatable about the pivoting shaft 251 relative to the fixed side wall part 240. Specifically, as illustrated in FIGS. 5 and 10, the pivoting shaft 251 is disposed to the second fixed side wall part 244, the pivoting end 252 of the movable housing part 250 is connected to the pivoting shaft 251, and the other end of the movable housing part 250 is a free end, and a distance between the free end of the movable housing part 250 and the fan wheel 301 is the minimal. Thus, the distance between the free end of the movable housing part 250 and the fitting end 245 of the first fixed side wall part 243 is relatively large, such that a degree of opening of the volute casing circulating air outlet 260 is relatively large when the movable housing part 250 is in the open position A2, the air quantity passing through the volute casing circulating air outlet 260 can be ensured, and operation efficiency of the range hood 1000 can be further ensured.

In some embodiments, as illustrated in FIGS. 5, 10 and 11, the volute casing 200 may further include a first limiting device 400, and the first limiting device 400 is disposed to the fixed housing part 240 and located between the fan wheel 301 and the movable housing part 250. The free end of the movable housing part 250 may be stopped on the first limiting device 400 when the movable housing part 250 is in the open position A2, and the first limiting device 400 can have a function of isolating the movable housing part 250 from the fan wheel 301 and can ensure the minimum distance between the movable housing part 250 and the fan wheel 301, thereby ensuring a normal operation of the range hood 1000.

In some embodiments, the first limiting device 400 can absorb the movable housing part 250 at the open position A2 by means of magnetic action. For example, the movable housing part 250 may be an iron member or an electromagnetic member, the first limiting device 400 may be a magnet, and the first limiting device 400 may generate an attractive force to absorb the movable housing part 250 thereto when the movable housing part 250 is rotated from the closed position A1 to the open position A2, such that the movable housing part 250 can be held in the open position A2.

In some embodiments, the first limiting device 100 is a limiting protrusion, and the movable housing part 250 abuts against the limiting protrusion when the movable housing part 250 is in the open position A2. The limiting protrusion may be integrally molded with the baseplate part 241 of the volute casing 200.

Further, as illustrated in FIGS. 2, 5 and 10, the volute casing 200 may further include a second limiting device 500, the second limiting device 500 is disposed to the fixed housing part 240 and the second limiting device 500 is located outside the movable housing part 250. The second limiting device 500 may be integrally molded with the baseplate part 241 of the fixed housing part 240. Specifically, when the movable housing part 250 is moved to the closed position A1 relative to the fixed housing part 240, the fixed housing part 240 is fitted with the movable housing part 250 and allows the air in the volute casing air passage 210 to be discharged from the volute casing exhaust outlet 230, and the second limiting device 500 stops an outer surface of the movable housing part 250.

In some embodiments, the second limiting device 500 may be a limiting rib that is arc-shaped, and the movable housing part 250 abuts against the limiting rib when the movable housing part 250 is in the closed position A1, such that the air pressure in the volute casing air passage 210 can be prevented from pressing the movable housing part 250 outwardly from the closed position A1 to some extent, the movable housing part 250 can be held in the closed position A1, the noise of the range hood 1000 can be reduced, and operational reliability of the range hood 1000 can be improved.

A holding device of the range hood 1000 according to embodiments of the present disclosure will be described below with reference to the drawings.

In some examples of the present disclosure, the volute casing 200 may further include a holding device (not illustrated), and the holding device is configured to hold the movable housing part 250 in the open position A2. It should be understood that the holding device can limit the movable housing part 250 to the open position A2. The movable housing part 250 is reset from the open position A2 to the closed position A1 under the action of the air pressure in the volute casing air passage 210.

Since the range hood 1000 has the function of discharging the air into the room and discharging the air outside the room, the user can set the range hood 1000 to discharge the air into the room according to requirement when temperature in the room is relatively low. When the range hood 1000 discharges the air into the room, the volute casing circulating air outlet 260 needs to be maintained in the open state normally, and the holding device can achieve this function. Thus, by providing the holding device, an air discharging state of the range hood 1000 can be controlled by the user conveniently, and the user experience can be improved.

Figure 6:
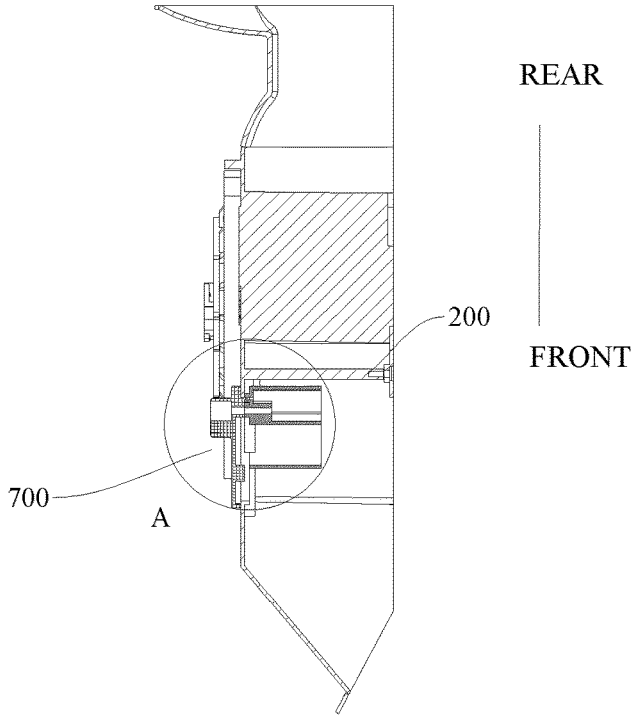
FIG. 6 is a sectional view of a volute casing of a range hood according to an embodiment of the present disclosure.
Figure 7:
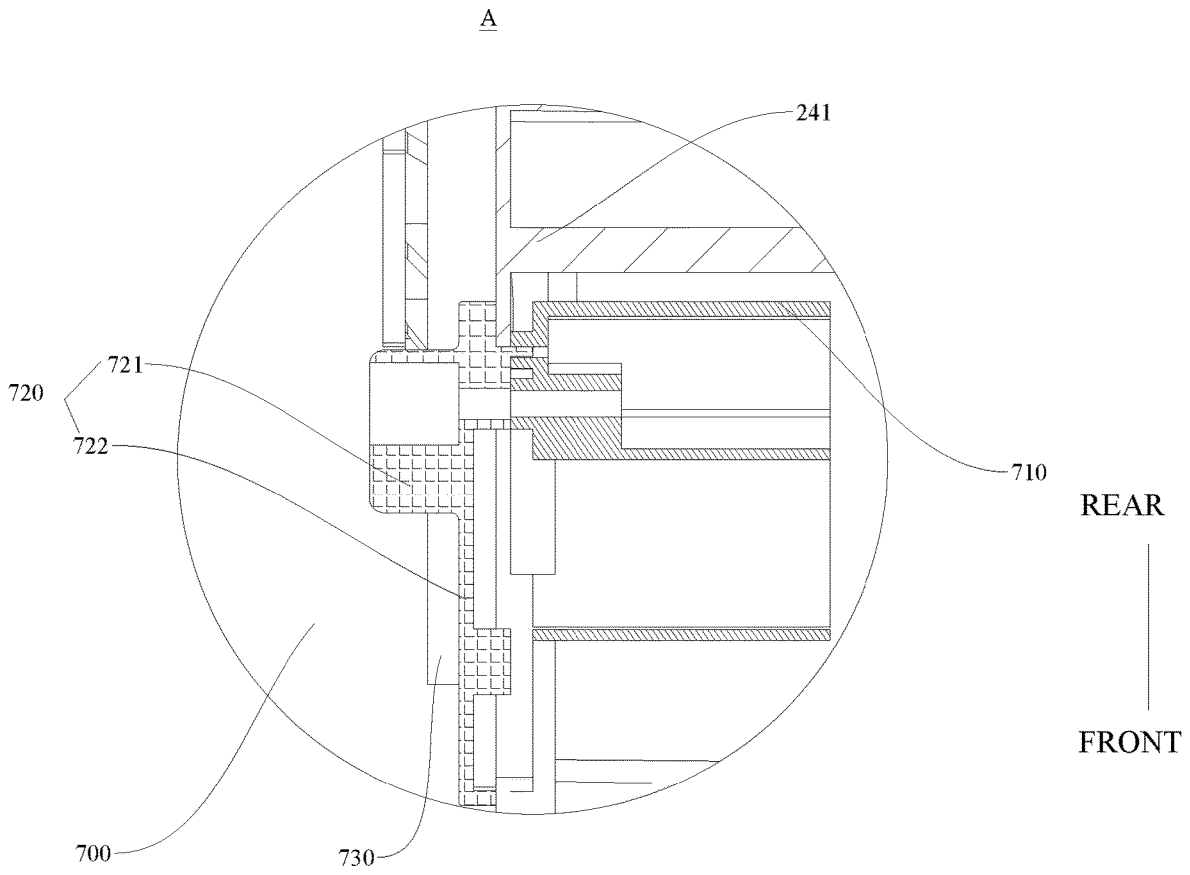
FIG. 7 is an enlarged view of part A in FIG. 6.

In some embodiments, as illustrated in FIGS. 6 and 7, the volute casing 200 may further include a switching drive device 700, and the switching drive device 700 is configured to drive the movable housing part 250 to move towards the open position A2. Further, the holding device is integrated into the switching drive device 700. It should be understood that the switching drive device 700 integrated with the holding device may have a function of driving the movable housing part 250, and may have a function of holding the movable housing part 250 in the open position A2. Thus, the holding device and the switching drive device 700 have a compact structure, small space occupation and convenient operation.

According to an optional embodiment of the present disclosure, the holding device may be a snap, and the snap is adapted to snap into the fixed housing part 240 when the movable housing part 250 is in the open position A2, so as to hold the movable housing part 250 in the open position A2. It should be understood that, the baseplate part 241 of the fixed housing part 240 may be provided with a snap groove fitted with the snap, and when the switching drive device 700 drives the movable housing part 250 to rotate to the open position A2, the snap may be snapped into the snap groove, such that the baseplate part 241 may hold the movable housing part 250 in the open position A2 by restricting a degree of freedom of the switching drive device 700.

According to another optional embodiment of the present disclosure, the holding device may be a threaded fastener, and the threaded fastener is adapted to be fastened to the fixed housing part 240 through a thread when the movable housing part 250 is in the open position A2, so as to hold the movable housing part 250 in the open position A2. It should be understood that, the switching drive device 700 and the baseplate part 241 of the fixed housing part 240 each may be provided with a screw hole, the screw hole of the switching drive device 700 coincides with the screw hole of the baseplate part 241 in an up-and-down direction, and the threaded fastener can pass through the screw hole of the switching drive device 700 and the screw hole of the baseplate part 241 sequentially to fix the switching drive device 700 on the baseplate part 241, such that the movable housing part 250 can be held in the open position A2.

According to still another optional embodiment of the present disclosure, the holding device may be an elastic bump, the fixed housing part 240 may be provided with the snap groove, and the elastic bump is adapted to be snapped into the snap groove when the movable housing part 250 is in the open position A2, so as to hold the movable housing part 250 in the open position A2. It should be understood that, when the switching drive device 700 drives the movable housing part 250 to rotate to the open position A2, the elastic bump may be snapped into the snap groove, such that the baseplate part 241 may hold the movable housing part 250 in the open position A2 by restricting the degree of freedom of the switching drive device 700.

According to still another optional embodiment of the present disclosure, the holding device is disposed to the fixed housing part 240, and the holding device absorbs the movable housing part 250 in the open position A2 by means of the magnetic action. In some embodiments, the holding device is the magnet, and the movable housing part 250 may be provided with a magnetic member capable of being magnetically absorbed by the magnet. For example, the movable housing part 250 may be the metal member or the electromagnetic member, and the holding device can hold the movable housing part 250 in the open position A2 by means of the attractive force.

The switching drive device 700 of the range hood 1000 according to embodiments of the present disclosure will be described below with reference to the drawings.

In some embodiments of the present disclosure, as illustrated in FIGS. 8 to 10, the switching drive device 700 may include a switching push plate 710, and the switching push plate 710 is configured to drive the movable housing part 250 to move towards the open position A2. A part of the switching push plate 710 or one end surface of the switching push plate 710 may abut against the outer surface of the movable housing part 250, whereby the switching push plate 710 can drive the movable housing part 250 to move from the closed position A1 to the open position A2 when the switching push plate 710 is moved.

In some embodiments, as illustrated in FIG. 4, the switching drive device 700 may further include a switching push handle 720, at least a part of the switching push handle 720 is exposed outside the volute casing 200, and the switching push handle 720 is connected to the switching push plate 710. That is to say, the user can control movement of the switching push plate 710 by operating the switching push handle 720, such that the switching push plate 710 can drive the movable housing part 250 to move. The switching push plate 710 and the switching push handle 720 may be split structures. Thus, assembly of the range hood 1000 can be facilitated, and production efficiency of the range hood 1000 can be improved.

The user can operate the switching push handle 720 by the part of the switching push handle 720 exposed outside the volute casing 200. Specifically, as illustrated in FIG. 7, the switching push handle 720 may include a connecting rod part 721 and a handle part 722, the handle part 722 is exposed outside the volute casing 200, the connecting rod part 721 is fixed to the handle part 722, and the connecting rod part 721 is connected to the switching push plate 710. For example, a groove may be defined in a lower surface of the switching push plate 710, and an upper surface of the connecting rod part 721 may be provided with a protrusion fitted with the groove. Thus, the switching push plate 710 may be inserted into the connecting rod part 721 of the switching push handle 720.

In some embodiments, as illustrated in FIG. 4, a sliding groove 730 may be defined in the fixed housing part 240, and the connecting rod part 721 is slidably mounted in the sliding groove 730. The sliding groove 730 may extend in a front-and-rear direction. Thus, the connecting rod part 721 may slide in the front-and-rear direction, such that the switching push plate 710 may drive the movable housing part 250 to move from the closed position A1 to the closed position A2 in the front-and-rear direction.

Further, the movable housing part 250 is rotatable about the pivoting shaft 251 relative to the fixed housing part 240, and the switching push plate 710 may abut against the movable housing part 250 to drive the movable housing part 250 to rotate about the pivoting shaft 251 towards the open position A2. It should be understood that, the switching push handle 720, the switching push plate 710 and the movable housing part 250 convert a linear displacement of the connecting rod part 721 to a pivoting movement of the movable housing part 250. In some embodiments, a surface of the switching push plate 710 abutting against the movable housing part 250 may be arc-shaped.

In some embodiments, as illustrated in FIGS. 8 and 9, the switching push plate 710 is provided with an air guiding surface 711, the air guiding surface 711 is configured to guide circulating air discharged from the volute casing 200 circulating exhaust outlet. As illustrated in FIG. 8, the air guiding surface 711 is opposite to the volute casing 200 circulating exhaust outlet, and the air guiding surface 711 is an arc-shaped air guiding surface 711. The air discharged from the volute casing circulating air outlet 260 flows to the air guiding surface 711 of the switching push plate 710, and the air guiding surface 711 can change the flow direction of the air to guide the air forward, such that the flow distance of the air from the volute casing circulating air outlet 260 to the hood circulating air outlet 101 can be shortened, and the operation efficiency of the range hood 1000 can be improved. Additionally, the air guiding surface 711 is configured as the arc-shaped guiding surface, such that when the air flows to the guiding surface, the noise produced by collision between the air and the guiding surface is relatively low, thereby reducing the noise of the range hood 1000.

Additionally, optionally, the switching drive device 700 may further include an electric driving member, the range hood 1000 may further be provided with a touch-control starting part, and the touch-control starting part is electrically connected to the electric driving member. Thus, the user only needs to touch the touch-control starting part according to practical requirements to achieve switch between the air discharge into the room and the air discharge outside the room, such that the range hood 1000 has simple operation and control, and the user experience is improved.

A specific arrangement way of the range hood 1000 according to embodiments of the present disclosure will be described in detail below.

The volute casing 200 includes the fixed housing part 240 and a plurality of movable housing parts 250. The fixed housing part 240 includes the baseplate part 241 and a plurality of fixed side wall parts 242, the volute casing air inlet 220 is defined in the baseplate part 241, and each fixed side wall part 242 is fixedly disposed to the baseplate part 241 and surrounds the respective volute casing air inlet 220. The plurality of movable housing parts 250 corresponds to the plurality of fixed side wall parts 242, and each movable housing part 250 is movable between the closed position A1 and the open position A2 relative to the respective fixed side wall part 242, in which the movable housing part 250 is staggered relative to the fixed side wall part 242 to define the volute casing circulating air outlet 260 between the movable housing part 250 and the fixed side wall part 242 when the movable housing part 250 is in the open position A2, and the volute casing circulating air outlet 260 is configured to allow the air in the volute casing air passage 210 to be discharged into the room through the volute casing circulating air outlet 260. In other words, the volute casing 200 defines a plurality of volute casing air inlets 220, and a plurality of fan wheel assemblies 300 may be in one-to-one correspondence with the plurality of volute casing air inlets 220; the volute casing 200 defines a plurality of volute casing air passages 210 therein, and the volute casing air passages 210 are in one-to-one correspondence with the volute casing air inlets 220; each volute casing 200 corresponds to one fixed side wall part 242 and one movable housing part 250, and the movable housing part 250 is movable between the open position A2 and the closed position A1.

The range hood 1000 further includes the switching drive device 700, and the switching drive device 700 is configured to drive the plurality of movable housing parts 250 to interact synchronously so that the plurality of movable housing parts 250 can be moved synchronously to the open position A2. It should be understood that, the switching drive device 700 may be associated with the plurality of movable housing parts 250 at the same time, and when the user controls the switching drive device 700 to move, the plurality of movable housing parts 250 may move synchronously along with the switching drive device 700, such that the plurality of volute casing circulating air outlets 260 can be opened simultaneously, and further the plurality of volute casing air passages 210 of the range hood 1000 can achieve the function of discharging the air into the room simultaneously.

It should be noted that, the term "interact" refers to associated movement between two components. For example, two gears meshed with each other, and when one gear is rotated, the other one is rotated synchronously.

Thus, in the range hood 1000 according to embodiments of the present disclosure, the switching drive device 700 is configured to drive the plurality of movable housing parts 250 to interact synchronously, such that the range hood 1000 can have the simple operation and control, and the user experience can be improved.

In some examples of the present disclosure, as illustrated in FIGS. 2 and 4, two fixed side wall parts 242 and two movable housing parts 250 are provided, and the two fixed side wall parts 242 correspond to the two movable housing parts 250 respectively. It should be understood that, one fixed side wall part 242 corresponds to one movable housing part 250, and the other fixed side wall part 242 corresponds to the other movable housing part 250. Each movable housing part 250 may be movable between the open position A2 and the closed position A1.

In some embodiments, as illustrated in FIG. 5, one group of the fixed side wall part 242 and the movable housing part 250 and the other group of the fixed side wall part 242 and the movable housing part 250 are symmetrically distributed on the baseplate part 241 in the left-and-right direction. Thus, the volute casing 200 has a simple structure and a reasonable arrangement.

In some embodiments, when the movable housing part 250 is in the closed position A1, the fixed housing part 242 is fitted with the movable housing part 250 and allows the air in the volute casing air passage 210 to be discharged from the volute casing exhaust outlet 230.

In some specific examples of the present disclosure, as illustrated in FIGS. 8 to 10, the switching drive device 700 may include the switching push plate 710, and the switching push plate 710 is configured to drive the two movable housing parts 250 to synchronously move towards the open position A2. A part of the switching push plate 710 or one end surface of the switching push plate 710 may abut against the outer surface of the movable housing part 250, whereby the switching push plate 710 can drive the two movable housing parts 250 to move from the closed position A1 to the open position A2 when the switching push plate 710 is moved.

Further, as illustrated in FIGS. 6 and 7, the switching drive device 700 may further include the switching push handle 720, at least a part of the switching push handle 720 is exposed outside the volute casing 200, and the switching push handle 720 is connected to the switching push plate 710. That is to say, the user can control the movement of the switching push plate 710 by operating the switching push handle 720, such that the switching push plate 710 can drive the two movable housing parts 250 to move. The switching push plate 710 and the switching push handle 720 may be split structures. Thus, the assembly of the range hood 1000 can be facilitated, and the production efficiency of the range hood 1000 can be improved.

The user can operate the switching push handle 720 by the part of the switching push handle 720 exposed outside the volute casing 200. Specifically, as illustrated in FIG. 7, the switching push handle 720 may include the connecting rod part 721 and the handle part 722, the handle part 722 is exposed outside the volute casing 200, the connecting rod part 721 is fixed to the handle part 722, and the connecting rod part 721 is connected to the switching push plate 710. For example, the groove may be defined in the lower surface of the switching push plate 710, and the upper surface of the connecting rod part 721 may be provided with the protrusion fitted with the groove. Thus, the switching push plate 710 may be inserted into the connecting rod part 721 of the switching push handle 720.

According to one embodiment of the present disclosure, the movable housing part 250 is rotatable about the pivoting shaft 251 relative to the fixed side wall part 242, two movable housing parts 250 are located at left and right sides of the switching push plate 710 respectively, and the switching push plate 710 abuts against the movable housing parts 250 at two sides of the switching push plate 710 separately to synchronously drive the two movable housing parts 250 to rotate about the respective pivoting shafts 251 towards the open position A2.

As illustrated in FIG. 10, the pivoting shaft 251 may be disposed to the second fixed side wall part 244 of the fixed side wall part 242, and the pivoting shafts 251 of the two movable housing parts 250 both can be disposed to the second fixed side wall part 244 of the fixed side wall part 242 and are spaced apart from each other in the left-and-right direction. The switching push plate 710 may be disposed adjacent to the two pivoting shafts 251, such that the switching push plate 710 can synchronously drive the two movable housing parts 250 to rotate about the respective pivoting shafts 251 from the closed position A1 to the open position A2. Specifically, the switching push plate 710 may be located at a middle position between the two movable housing parts 250, and the switching push plate 710 can push against the pivoting end 252 of the movable housing part 250 connected to the pivoting shaft 251.

In some embodiments, as illustrated in FIG. 8, the switching push plate 710 is provided with a left-side air guide surface and a right-side air guide surface, the left-side air guide surface is configured to guide circulating air discharged from the volute casing 200 circulating exhaust outlet at a left side, and the right-side air guide surface is configured to guide circulating air discharged from the volute casing 200 circulating exhaust outlet at a right side. Moreover, the left-side air guide surface is opposite to the volute casing 200 circulating exhaust outlet at the left side, the right-side air guide surface is opposite to the volute casing 200 circulating exhaust outlet at the right side, and the left-side air guide surface and the right-side air guide surface are both arc-shaped air guiding surfaces 711. Thus, the air discharged from the volute casing circulating air outlet 260 at the left side can be discharged from the hood circulating air outlet 101 under the guidance of the left-side air guide surface, and the air discharged from the volute casing circulating air outlet 260 at the right side can be discharged from the hood circulating air outlet 101 under the guidance of the right-side air guide surface.

The left-side guiding surface 711 and the right-side guiding surface 711 are both arc-shaped guiding surfaces, such that the noise of the range hood 1000 can be reduced.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature. While a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, without conflicting, various embodiments or examples or features of various embodiments or examples described in the present specification may be combined by those skilled in the art.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A range hood, comprising:

a hood housing, provided with a hood circulating air outlet and a hood exhaust outlet;

a volute casing, having at least a portion disposed in the hood housing, defining a volute casing air passage therein, provided with a volute casing air inlet and a volute casing exhaust outlet that is in communication with the hood exhaust outlet, and comprising a fixed housing part and a movable housing part, the movable housing part being movable between a closed position and an open position relative to the fixed housing part, wherein:

when the movable housing part is in the closed position, the fixed housing part is fitted with the movable housing part and air in the volute casing air passage is configured to be discharged from the volute casing exhaust outlet, when the movable housing part is in the open position, the movable housing part is positioned relative to the fixed housing part to define a volute casing circulating air outlet in communication with the hood circulating air outlet and between the movable housing part and the fixed housing part, so as to allow the air in the volute casing air passage to be discharged into a room through the volute casing circulating air outlet and the hood circulating air outlet sequentially.

2. The range hood according to claim 1, wherein the fixed housing part further comprises:

a baseplate part, the volute casing air inlet being provided in the baseplate part; and a fixed side wall part fixedly disposed to the baseplate part and surrounding the volute casing air inlet, wherein a position of the movable housing part relative to the fixed side wall part is adjustable to define the volute casing circulating air outlet between the movable housing part and the fixed side wall part when the movable housing part is in the open position.

3. The range hood according to claim 2, wherein a molded line of the movable housing part is on a same spiral as a molded line of the fixed side wall part when the movable housing part is in the closed position.

4. The range hood according to claim 2, wherein the fixed side wall part further comprises: a first fixed side wall part and a second fixed side wall part spaced apart from each other, the movable housing part is disposed between the first fixed side wall part and the second fixed side wall part, and two ends of the movable housing part are in butt joint with the first fixed side wall part and the second fixed side wall part respectively when the movable housing part is in the closed position so that the first fixed side wall part, the movable housing part and the second fixed side wall part are continuous in an extending direction of the volute casing air passage.

5. The range hood according to claim 4, wherein the volute casing exhaust outlet is defined between a free end of the first fixed side wall part and a free end of the second fixed side wall part.

6. The range hood according to claim 4, wherein the movable housing part is pivotal about a pivoting shaft relative to the fixed side wall part.

7. The range hood according to claim 4, wherein the first fixed side wall part is an arc-shaped wall and an opening of the first fixed side wall faces the second fixed side wall part, and the second fixed side wall part is formed as a substantially flat-plate structure.

8. The range hood according to claim 7, wherein two fixed side wall parts are provided and symmetrically arranged on the baseplate part, openings of the first fixed side wall parts of the two fixed side wall parts face each other, and the two fixed side wall parts share the same second fixed side wall part.

9. The range hood according to claim 1, further comprising a fan wheel assembly, wherein the fan wheel assembly is at least partially disposed in the volute casing air passage and comprises a fan wheel and a drive motor, and a minimum distance L between the movable housing part and the fan wheel satisfies a relation: 5 mm≤L≤30 mm.

10. The range hood according to claim 9, wherein the movable housing part is rotatable relative to the fixed housing part via a pivoting shaft, a pivoting end of the movable housing part is connected to the pivoting shaft while the other end of the movable housing part is a free end, and a distance between the free end of the movable housing part and the fan wheel is the minimal.

11. The range hood according to claim 1, further comprising a fan wheel assembly and a first limiting device, wherein the fan wheel assembly is at least partially disposed in the volute casing air passage and comprises a fan wheel and a drive motor, and the first limiting device is disposed to the fixed housing part and located between the fan wheel and the movable housing part.

12. The range hood according to claim 11, further comprising a second limiting device, wherein the second limiting device is disposed to the fixed housing part and located outside the movable housing part.

13. The range hood according to claim 1, further comprising a switching drive device, wherein the switching drive device is configured to drive the movable housing part to move towards the open position.

14. The range hood according to claim 13, wherein the switching drive device comprises a switching push plate, and the switching push plate is configured to drive the movable housing part to move towards the open position.

15. The range hood according to claim 14, wherein the switching drive device further comprises a switching push handle, and at least a part of the switching push handle is exposed outside the volute casing and is connected to the switching push plate.

16. The range hood according to claim 14, wherein the switching push plate is provided with an air guiding surface configured to guide circulating air discharged from the volute casing circulating exhaust outlet.

17. The range hood according to claim 1, wherein the movable housing part is reset from the open position to the closed position under the action of air pressure in the volute casing air passage.

18. The range hood according to claim 1, wherein the volute casing further comprises:

the fixed housing part, comprising a baseplate part and a plurality of fixed side wall parts, the volute casing air inlet being provided in the baseplate part, and each fixed side wall part being fixedly disposed to the baseplate part and surrounding the respective volute casing air inlet;

a plurality of the movable housing parts corresponding to the plurality of fixed side wall parts, and each movable housing part being movable between the closed position and the open position relative to the respective fixed side wall part, wherein the movable housing part is positioned relative to the fixed side wall part to define the volute casing circulating air outlet between the movable housing part and the fixed side wall part when the movable housing part is in the open position, and the volute casing circulating air outlet is configured to allow the air in the volute casing air passage to be discharged into the room through the volute casing circulating air outlet;

the range hood further comprises a switching drive device configured to drive the plurality of movable housing parts to interact synchronously so that the plurality of movable housing parts can be moved synchronously to the open position.

19. The range hood according to claim 18, wherein the switching drive device comprises:

a switching push plate configured to drive two movable housing parts to move synchronously towards the open position;

a switching push handle, at least a part of the switching push handle being exposed outside the volute casing and connected to the switching push plate, the switching push handle comprising a connecting rod part and a handle part, the handle part being exposed outside the volute casing, and the connecting rod part being fixed to the handle part and connected to the switching push plate.

20. The range hood according to claim 1, wherein the hood circulating air outlet is provided in the hood housing located above a front of the volute casing circulating air outlet.

* * * * *